US005143298A

United States Patent [19]

Prokopoff

[11] Patent Number: 5,143,298

[45] Date of Patent: Sep. 1, 1992

[54] SPRAY NOZZLE ASSEMBLY WITH SWIVEL MOUNTED HOLLOW CONE SPRAY TIP

[75] Inventor: Alexander S. Prokopoff, Chicago, Ill.

[73] Assignee: MAN Roland Druckmaschinen AG, Fed. Rep. of Germany

[21] Appl. No.: 606,438

[22] Filed: Oct. 31, 1990

[51] Int. Cl.[5] ..... B05B 1/34; B05B 15/08

[52] U.S. Cl. ..... 239/494; 239/587.4

[58] Field of Search ..... 239/209, 282, 283, 463, 239/487, 488, 489, 491, 493, 494–497, 587, 590–590.5

[56] References Cited

U.S. PATENT DOCUMENTS

| | | | |
|---|---|---|---|
| 1,976,062 | 10/1934 | Estep | 239/497 |
| 3,831,681 | 8/1974 | Livingston | 239/209 |
| 4,406,407 | 9/1983 | Aprea et al. | 239/487 |

FOREIGN PATENT DOCUMENTS

| | | | |
|---|---|---|---|
| 0657858 | 4/1979 | U.S.S.R. | 239/489 |
| 0773294 | 10/1980 | U.S.S.R. | 239/587 |

*Primary Examiner*—Andres Kashnikow
*Assistant Examiner*—Karen B. Merritt
*Attorney, Agent, or Firm*—Leydig, Voit & Mayer

[57] ABSTRACT

A spray nozzle assembly including a body and a nozzle tip having a ball-shaped mounting end for selected swivel positioning within a socket in the body. The nozzle tip contains a vane for imparting swirling movement to liquid passing through the nozzle assembly such that the discharging liquid has a hollow cone spray pattern. The vane has a pair of liquid flow passageways each having a diameter of at least 0.22 the diameter of the ball-shaped mounting end of the tip and at least 0.32 the diameter of the vane for permitting the free passage of liquids with relatively larger solid materials than heretofore possible with comparably sized nozzle elements. To ensure that the vane passageways extend through the vane without the existence of an axial see-through condition, the vane has a chamfered upstream end extending outwardly of the tip.

34 Claims, 4 Drawing Sheets

SPRAY NOZZLE ASSEMBLY WITH SWIVEL MOUNTED HOLLOW CONE SPRAY TIP

FIELD OF THE INVENTION

The present invention relates generally to spray nozzle assemblies, and more particularly, to spray nozzle assemblies of the type which have a selectively positionable swivel-mounted spray tip adapted for producing a hollow cone spray pattern.

BACKGROUND OF THE INVENTION

Spray nozzle assemblies are known, sometimes body that may be clamped to a liquid supply pipe and which supports a nozzle tip in a conical socket for swivel movement in order to permit selected direction of the discharging spray. While various types of spray tips may be supported in the body socket, nozzle assemblies of such type which include a tip adapted for producing a hollow cone spray pattern have been particularly problem prone. In such nozzle assemblies, the spray tip commonly includes a vane upstream of the discharge orifice of the tip for imparting a whirling action to liquid sufficient to discharge the spray in a conical pattern about a central hollow air core.

Since such hollow cone nozzle assemblies are used in many industrial applications for spraying liquids that contain various types and sizes of solid materials, it is desirable that liquid passageways in the vane and tip be as large as possible to permit the free passage of the solids in the flow stream. On the other hand, space constraints dictated by the universal design of the tip supporting body or particular application specifications, commonly require that the nozzle tip and vane be of limited size. In such case, it has been proposed to utilize a vane with a single relatively large port or passageway in order to permit the free passage of the solids containing flow streams. Such single port vanes, however, usually are ineffective in generating whirling action sufficient for producing a uniform hollow cone spray pattern. Instead, the discharging spray pattern can be uneven, and this condition can worsen depending upon the particular orientation of the nozzle tip. Moreover, relatively short length vanes dictated by space limitations may not allow for sufficiently long vane passageways to effect adequate tangential direction of the passing liquid, nor prevent the existence of an axial see-through condition in the nozzle that permits the straight passage of a portion of the liquid without effect by the vane, which again deters from the performance of the nozzle and the desired spray pattern. To compensate for these problems, heretofore it has been necessary to utilize a vane with relatively small passages.

OBJECTS AND SUMMARY OF THE INVENTION

It is an object of the present invention to provide a spray nozzle assembly having a swivel mounted spray tip adapted for more effectively generating a uniform hollow cone spray pattern throughout its range of selective movement.

Another object is to provide a spray nozzle assembly as characterized above which is relatively small in size. A related object is to provide a nozzle assembly of the foregoing type in which the nozzle body has a relatively small diameter tip receiving socket that may be used with a variety of spray tips.

A further object is to provide a spray nozzle assembly of the above kind which includes a relatively small sized spray tip with a vane adapted for more effective tangential direction of liquid flow streams with relatively large sized solids.

Still another object is to provide a spray nozzle assembly of the foregoing type in which the swivel mounted tip has a dual passage vane and a relatively large diameter discharge orifice that permit unrestricted passage of relatively large sized solid materials within the liquid flow stream.

Other objects and advantages of the invention will become apparent upon reading the following detailed description and upon reference to the drawings, in which:

Figure 3:
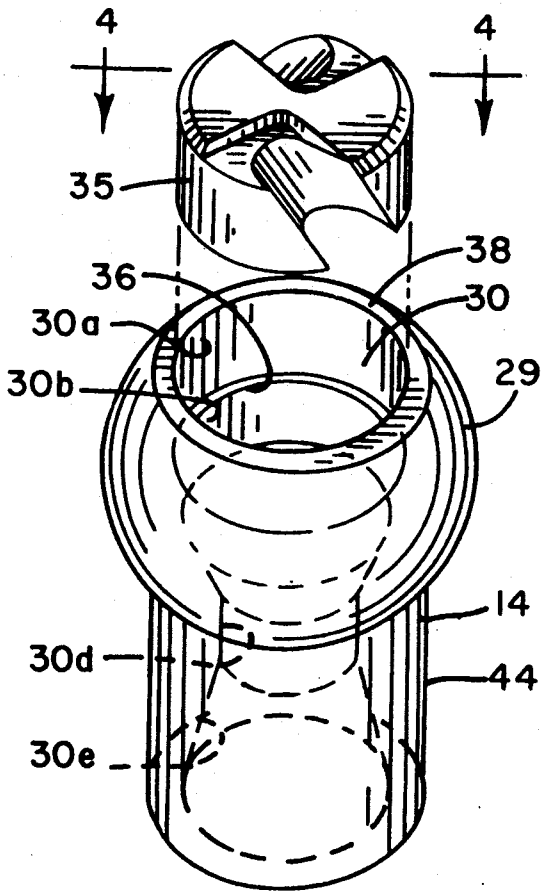
FIG. 3 is an exploded perspective of the nozzle tip and vane of the illustrated spray nozzle assembly.
Figure 1:
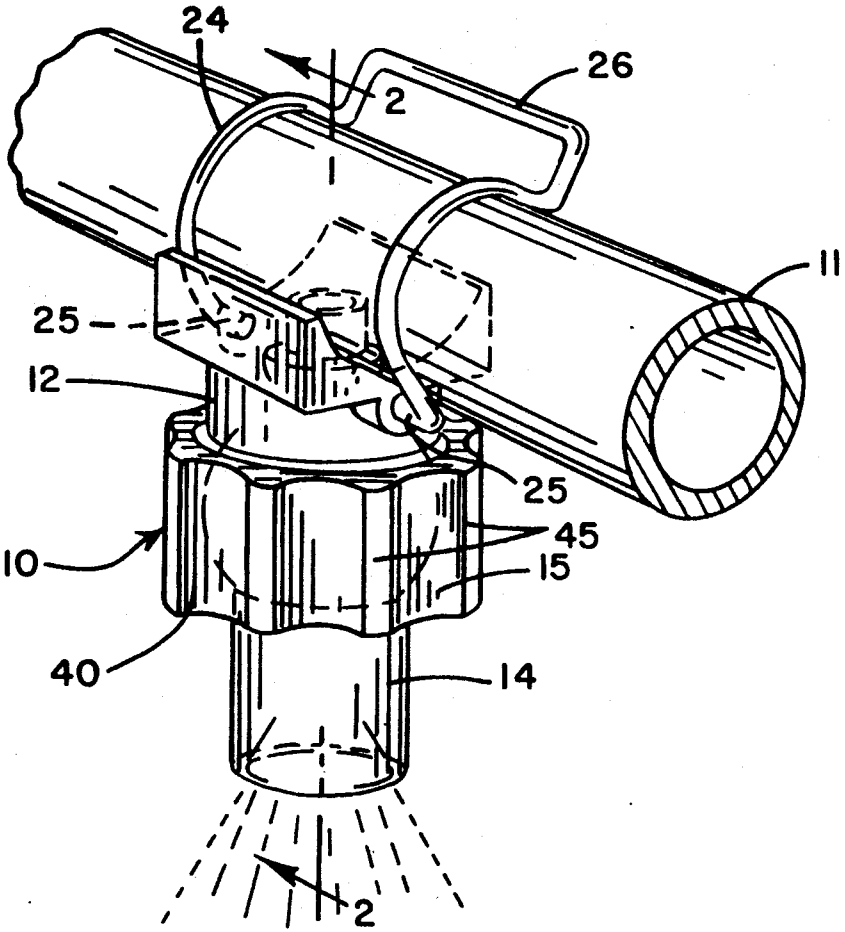
FIG. 1 is a perspective of a spray nozzle assembly embodying the present invention mounted on a liquid supply pipe.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to the drawings, there is shown an illustrative spray nozzle assembly 10 embodying the present invention mounted on a pipe or liquid supply conduit 11. The supply conduit 11 typically would support a plurality of such nozzle assemblies at longitudinally spaced intervals and would be supplied with pressurized liquid, which may or may not include solid materials of various size.

Figure 2:
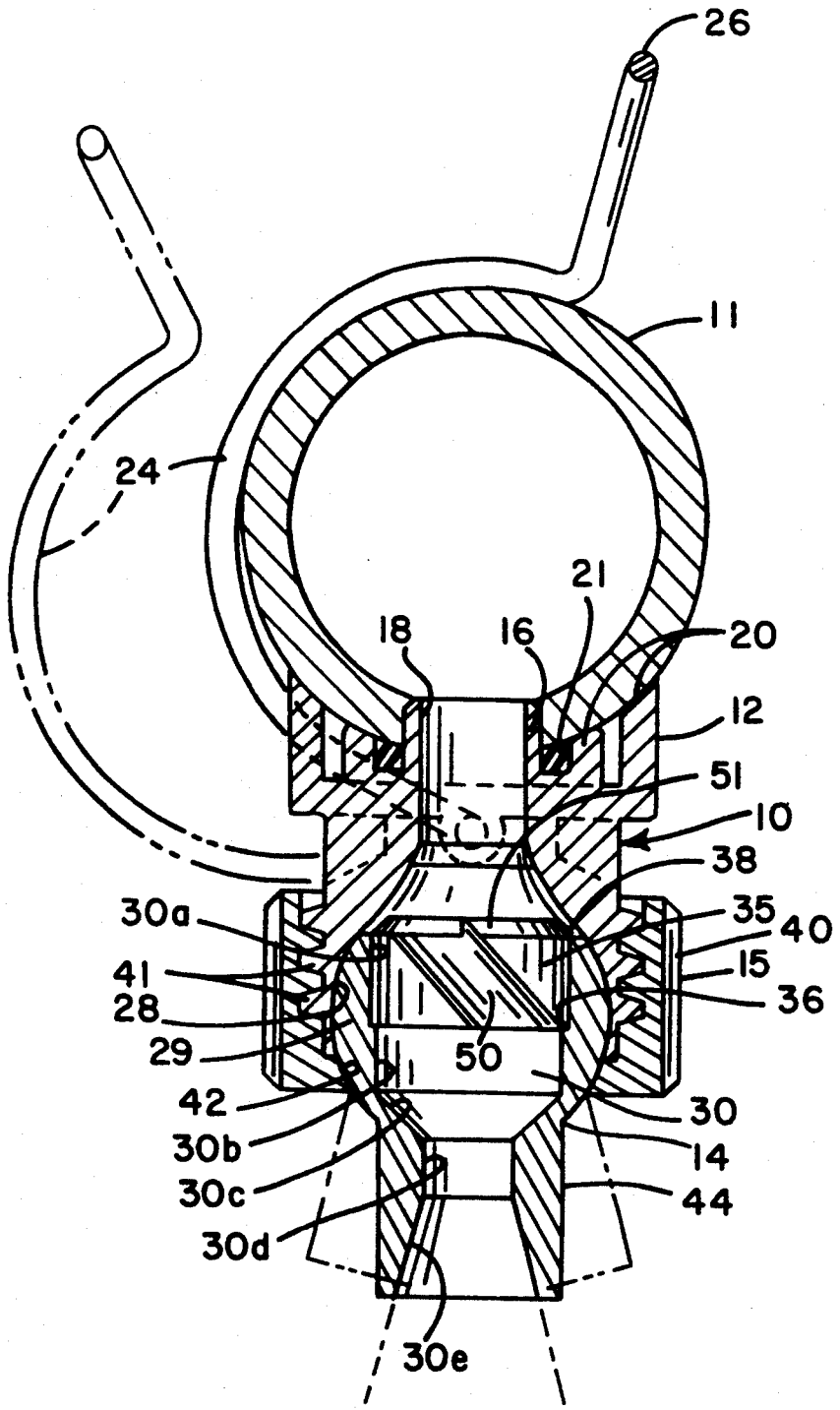
FIG. 2 is an enlarged vertical section of the spray nozzle assembly shown in FIG. 1, taken in the plane of line 2—2.
Figure 4:
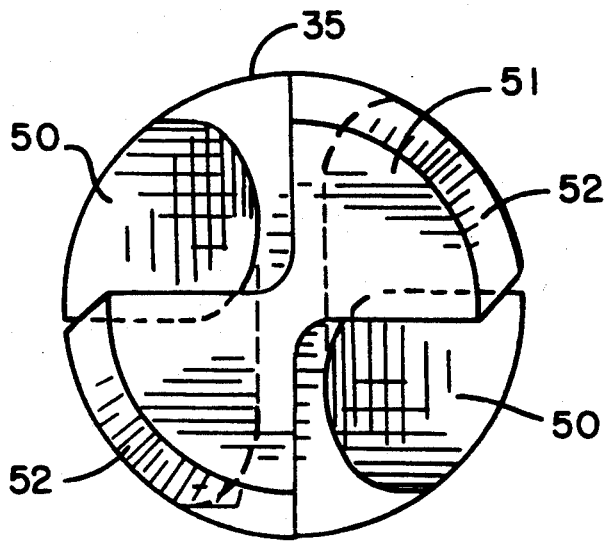
FIG. 4 is an enlarged upstream end view of the vane of the illustrated spray nozzle assembly taken in the plane of line 4—4 in FIG. 3.

The nozzle assembly 10 basically comprises a body 12, a nozzle tip 14 mounted for selective swivel positioning within the body 12, and a cap 15 for removably retaining the tip 14 in mounted position in the body. The nozzle body 12 is mounted on the underside of the supply conduit 11 and has an upstanding nipple 16 positioned within an aperture in the underside of the supply conduit 11 for permitting communication of liquid from the supply conduit 11 to a passageway 18 in the body 12. The nozzle body 12 has a curved base 20 of a diameter corresponding to the diameter of the conduit 11, and an "0" ring sealing member 21 is disposed about the nipple 16 in interposed relation between the conduit 11 and the body 12. For removably mounting the nozzle assembly 10 on the liquid supply conduit 11, an arcuate configured clip 24 is secured to the body 12. The clip 24 has inwardly directed opposed ends 25 engageable in mounting apertures in opposed longitudinal sides of the body 12 that support the clip 24 for pivotal movement between a retracted position, shown in phantom in FIG. 2, and a mounted position engageably surrounding the supply conduit 11. The clip 24 in this instance has a handle portion 26 extending outwardly from the conduit 11 when in its mounted position to facilitate easy pivoting of the clip 24 during mounting and disassembly.

For permitting selective positioning of the tip 14 relative to the body 12, the body 12 is formed with a ball shaped socket recess 28 on its underside for receiving a ball shaped mounting end 29 of the tip 14. The recess 28 preferably has a relatively small radius, on the order of .56 inches, and is adapted for receiving common diameter mounting ends 29 of any of a variety of nozzle tips. For permitting the free passage of liquid to the tip 14 over the full range of movement of the tip 14 relative to the body 12, the body passageway 18 is formed with an enlarged counterbore section 27 immediately upstream of the tip 14.

The tip 14 has a fluid passageway 30 communicating with the body passageway 18. The spray tip fluid passageway 30 is defined by a relatively large diameter upstream bore 30*a*, a whirl chamber 30*b* having an inwardly tapered, conical downstream end 30*c*, and a cylindrical discharge orifice 30*d* having an outwardly tapered conical discharge end 30*e*. For imparting swirling and tangential movement to liquid passing through the nozzle, a vane 35 is mounted within the upstream bore 30*a* of the tip 14. The bore 30*a* in this case is slightly larger in diameter than the whirl chamber 30*b* for defining a shoulder 36 against which the vane 35 is seated. The tip 14 has a flat upstream end 38, adjacent the entrance to the passage 30, which is in a plane perpendicular to the axis of the tip 14.

For retaining the nozzle tip 14 in mounted position in the body socket 28 and for securing it in a selectedly adjusted position for directing the spray from the discharge orifice 30*d* in the desired direction, the retaining cap 15 is adapted for threadable engagement with external threads 41 of the body 12. The retaining cap 15 is formed with a central circular opening 42 slightly smaller in diameter than the diameter of the ball shaped mounting end 29 of the tip 14. It will be seen that by virtue of the ball and socket mounting of the tip 14 in the body 12, the tip 14 may be swiveled in a circular fashion relative to the body, limited by engagement of a depending cylindrical end 44 of the tip with the perimeter of circular opening 42 of the cap 15, and when properly positioned, the tip 14 may be secured by tightening of the cap 15 onto the threaded end of the body 12. The cap 15 in this instance has circumferentially spaced vertically oriented ridges 45 about its perimeter to facilitate gripping and turning of the cap 15 into and out of clamping engagement with the tip 14.

Figure 5:
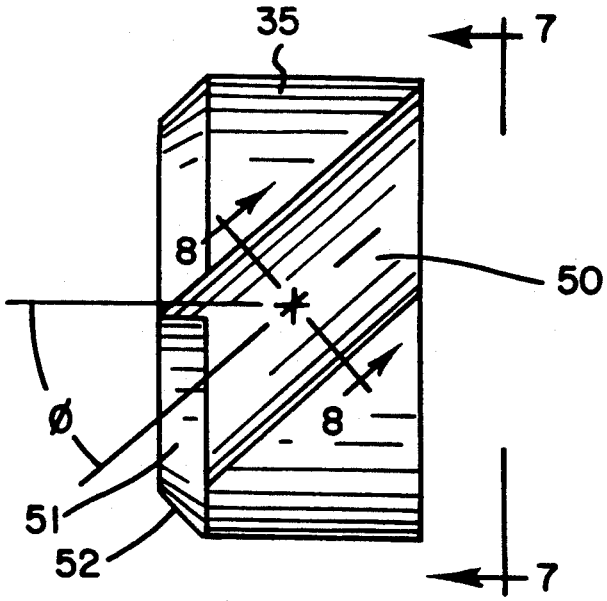
FIGS. 5 and 6 are right side and front views, respectively, of the vane shown in FIG. 4.
Figure 6:
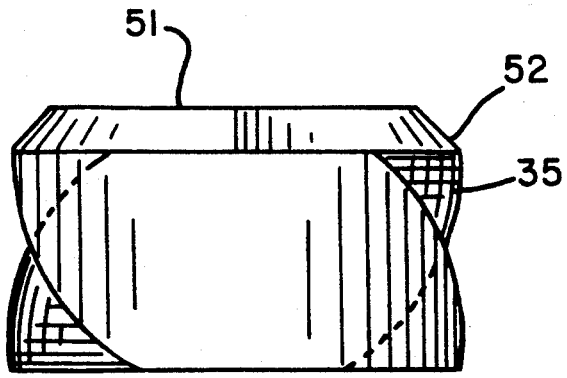
Figure 7:
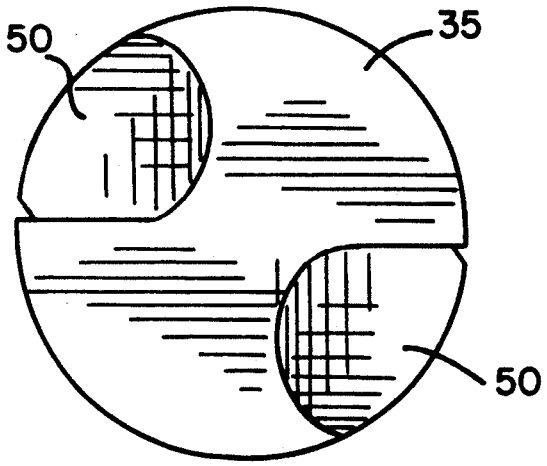
FIG. 7 is a downstream end view of the vane taken in the plane of line 7—7 in FIG. 5.
Figure 8:
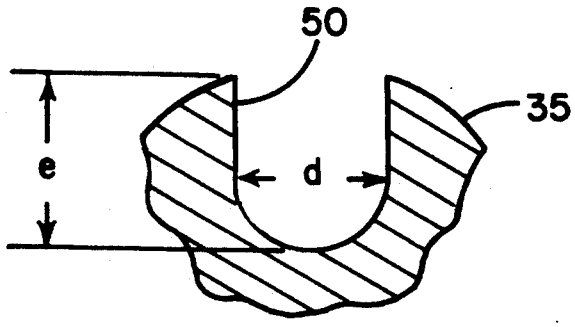
FIG. 8 is a fragmentary section taken in the plane of line 8—8 in FIG. 5.

In accordance with the invention, the vane has a pair of relatively large diameter flow passageways and the tip has a comparatively sized discharge orifice for permitting the free passage of liquids with relatively large sized solids while being adapted for imparting sufficient whirling movement to the liquid in the whirl chamber such that a hollow cone spray with substantial uniformity is effected at any selected swiveled position of the nozzle tip. In the illustrated embodiment, the vane 35 is formed with a pair of angularly oriented flow passageways 50 on diametrically opposed sides thereof. The flow passageways 50 in this instance each are defined by an outwardly opening U-shaped slot having a diameter "d" and extending a distance "e" into the vane (FIG. 8). For imparting substantially tangential direction to the liquid exiting the vane into the whirl chamber 30*b* of the nozzle tip 14, the passageways 50 preferably each have an exit angle $\phi$ relative to the longitudinal axis of the tip of at least 40°, and preferably about 42° (FIG. 5). To facilitate manufacture, the slots that define the vane passageways 50 extend in straight fashion through the nozzle tip 14 at a constant angle $\phi$ relative to the longitudinal axis of the spray tip.

In carrying out the invention, the diameters of the vane passageways are relatively large as compared to the diameters of the vane and mounting end of the tip. More particularly, the ratio of the diameter "d" of the vane liquid passageways 50 to the diameter of the ball-shaped mounting end 29 of the tip is at least 0.22 and preferably about 0.24, and the ratio of the diameter "d" of the vane passage to the diameter of the vane is at least 0.32 and preferably about 0.34. The diameter of the nozzle tip discharge orifice 30*d* preferably is the same as the diameter "d" of the vane passageways. However, in order to utilize the same vane 35 and body 12 for spray tips 14 having different discharge orifices 30*d* for particular spraying requirements, thereby minimizing inventory and manufacturing costs, nozzle tips 14 may be used which have common sized ball-shaped mounting ends 26, but discharge orifices 30*d* that are larger and smaller than the vane passage diameter "d" within acceptable limits.

In accordance with a further feature of the invention, in order that the vane passageways have sufficient lengths to prevent the existence of an axial see-through condition in the vane 35, or in other words, a condition in which a portion of the liquid can pass straight through the vane 35 without effect from the vane and discharge from the nozzle tip within the air core or center of the hollow cone spray pattern, the vane 35 has an upstream extension or end 51 extending outwardly of the nozzle tip bore 30*a*. The extension 51, which may be on the order of 0.18 the length of the vane 35, enables the vane passageways 50 to have sufficient length to prevent an axial see-through condition. Without the extension, it will be understood by one skilled in the art that the vane passageways 50 would have to be disposed at a greater angle $\phi$ relative to the longitudinal axis of the tip to prevent axial see-through, which in turn would necessitate forming the flow passageways 50 with a smaller diameter, which in turn would impede or prevent the free passage of larger solid materials within the flow stream. The upstream extension 51 of the vane 35 in this instance is formed with a chamfer 52 so that the extension 51 does not impede pivotal movement of the tip 14 within the body socket 28.

In practice, the spray nozzle assembly 10 of the present invention has been found effective for generating relatively uniform distribution hollow cone spray patterns with liquids containing relatively larger sized solids, as compared to prior similarly sized nozzle assemblies. Such nozzle assemblies may employ relatively small socket diameters for the nozzle tip 14, such as less than 1.2 inches. In a typical nozzle assembly, the nozzle tip 14 has a ball shaped mounting end 29 of a diameter of 1.125 inches mounted in a similarly size socket in the body. The vane 35 has a diameter of 0.804 inches and is disposed in the bore 30*a* in the tip 14 with a slight interference fit. The vane 35 is formed with a pair of vane passageways 50 each having a diameter "d" of 0.274 inches and extending inwardly from the periphery of the vane a distance "e" of 0.342 inches. The vane 35 ° has an overall length of 0.451 inches, with an end 52 extending outwardly of the nozzle tip a distance 0.080 inches. The vane passageways 50 have an exit angle $\phi$ of 42° with respect to the longitudinal axis of the tip 14 and extend through the vane 35 in straight fashion on diametrically opposed sides thereof without the existence of an axial see-through condition in the vane. While preferably the discharge orifice 30*d* of the spray tip 14 has a diameter corresponding similarly to the diameter d of the vane passageways 50, in order to minimize inventory and manufacturing costs, as indicated above, the nozzle body 12 and vane 35 may be used to accommodate nozzle tips 14 with varying sized discharge orifices 30*d* for particular spraying applications. In practice, acceptable spraying of liquids with relatively large sized solid materials has been achieved in the nozzle assembly referred to above with spray tips 14 having discharge orifice diameters 30*d* that vary from 0.200 inches to 0.344 inches in diameter.

From the foregoing, it can be seen that the nozzle assembly of the present invention is adapted for effectively generating a uniform hollow cone spray pattern utilizing a nozzle body formed with a relatively small diameter nozzle tip receiving socket that may be used to support a variety of spray tips. While the ball-shaped mounting end of the nozzle tip and the vane are relatively small in size, they are effective for hollow cone spraying of liquids containing relatively larger sized solid materials than heretofore possible with comparably sized nozzle bodies and tips.

What is claimed is:

1. A spray nozzle assembly comprising a body formed with a liquid flow passageway and a ball-shaped socket, a nozzle tip having a fluid passageway for communication with said body passageway and a ball shaped mounting end for selected swivel positioning within said body socket, means for retaining said nozzle tip in a selected swivel position in said body socket so that liquid directed through said body and tip passageways discharges from said tip in a predetermined direction with respect to said body, a vane for imparting swirling movement to liquid directed through said tip whereby liquid discharging from said tip has a hollow cone spray pattern, said vane having a pair of liquid flow passageways communicating with said body and tip passageways, and said vane passageways each having a diameter of at least 0.22 the maximum diameter of the ball shaped mounting end of said tip and extending through said vane without the existence of an axial see-through condition so that all liquid passing through the vane is tangentially directed.

2. The nozzle assembly of claim 1 in which said vane is a cylindrical member and said vane passageways are disposed on diametrically opposed sides thereof.

3. The nozzle assembly of claim 2 in which said vane passageways are formed by outwardly opening U-shaped slots in opposed sides of the vane.

4. The spray nozzle assembly of claim 1 in which said vane passageways extend through said nozzle in a straight line.

5. The spray nozzle assembly of claim 1 in which said nozzle tip passageway defines an upstream bore within which said vane is mounted, a whirl chamber downstream of said vane, and a discharge orifice downstream of said whirl chamber.

6. The nozzle assembly of claim 5 in which said discharge orifice has a cylindrical configuration with an outwardly flared downstream end.

7. The spray assembly of claim 1 in which said vane has an end portion extending outwardly of the upstream end of said nozzle tip, and said vane end portion is chamfered so as not to interfere with pivotal positioning of said nozzle tip within said body socket.

8. The nozzle assembly of claim 1 in which the ratio of the diameter of each vane passageway to the diameter of the ball-shaped mounting end of the tip is about 0.24.

9. The nozzle assembly of claim 1 in which the ratio of each vane passageway to the diameter of the vane is at least 0.32.

10. The nozzle assembly of claim 1 in which said body passageway includes an enlarged counterbore section immediately upstream of the nozzle tip.

11. A spray nozzle assembly comprising a body formed with a liquid flow passageway and a ball-shaped socket, a nozzle tip having a fluid passageway for communication with said body passageway and a ball shaped mounting end for selected swivel positioning within said body socket, means for retaining said nozzle tip in a selected swivel position in said body socket so that liquid directed through said body and nozzle tip passageways discharges from said tip in a predetermined direction with respect to said body, a cylindrical vane disposed in an upstream end of said nozzle tip for imparting swirling movement to liquid directed through said tip whereby liquid discharging from said tip has a hollow cone spray pattern, said vane having a pair of liquid flow passageways communicating with said body and tip passageways, and said vane passageways each having a diameter of at least 0.32 the diameter of the vane and extending through said vane without the existence of an axial see-through condition so that all liquid passing through the vane is tangentially directed.

12. The nozzle assembly of claim 11 in which said nozzle tip liquid passageway defines a discharge orifice, and means defining a whirl chamber downstream of said vane and upstream of said nozzle tip discharge orifice.

13. A spray nozzle assembly comprising a body formed with a liquid flow passageway and a ball-shaped socket, a nozzle tip having a fluid passageway for communication with said body passageway and a ball shaped mounting end for selected swivel positioning within said body socket, means for retaining said nozzle tip in a selected swivel position in said body socket so that liquid directed through said body and tip passageways discharges from said tip in a predetermined direction with respect to said body, and a vane disposed within an upstream end of said nozzle tip and being formed with a pair of passageways for imparting swirling movement to liquid directed through said tip whereby liquid discharging said tip has a hollow cone spray pattern, said vane having an end portion extending outwardly of the upstream end of said tip, and said vane passageways extending through said vane without the existence of an axial see-through condition so that all liquid passing through the vane is imparted a tangential velocity component.

14. The spray nozzle assembly of claim 13 in which each said vane passageway directs liquid into said whirl chamber at an exit angle of at least 40° to the longitudinal axis of said tip.

15. A spray nozzle assembly comprising a body formed with a liquid flow passageway and a ball-shaped socket, a nozzle tip having a fluid passageway for communication with said body passageway and a ball shaped mounting end for selected swivel positioning within said body socket, said nozzle tip fluid passageway defining a discharge orifice and a whirl chamber upstream of said discharge orifice, means for retaining said nozzle tip in a selected swivel position in said body socket so that liquid directed through said body and tip passageways discharges from said tip in a predetermined direction with respect to said body, and a vane disposed in an upstream end of said nozzle tip and being formed with a pair of fluid passageways for imparting swirling movement to liquid directed through said tip into said whirl chamber whereby liquid discharging from said discharge orifice has a hollow cone stray pattern, said vane having an upstream end extending outwardly of said nozzle tip, and said vane passageways extending through the vane without the existence of an axial see-through condition so that all liquid passing through the vane is tangentially directed into said whirl chamber.

16. The nozzle assembly of claim 15 in which the ratio of each vane passageway to the diameter of the vane is at least 0.32.

17. A spray nozzle assembly comprising a body formed with a liquid flow passageway and a ball-shaped socket, a nozzle tip having a fluid passageway which defines a discharge orifice in communication with said body passageway and a ball-shaped mounting end for selected swivel positioning within said body socket, means for retaining said nozzle tip in a selected swivel position in said body socket so that liquid directed through said body and tip passageways discharges from said tip in a predetermined direction with respect to said body, a vane having a pair of liquid flow passageways communicating with said body and tip passageways for imparting swirling movement to liquid directed through said tip whereby liquid discharging from said tip has a hollow cone spray pattern, and said body socket having a maximum diameter of less than 1.2 inches, said vane passageways having a diameter of at least 0.25 inches and extending through said vane without the existence of an axial see-through condition so that all liquid passing through the vane is tangentially directed, and said nozzle tip having a discharge orifice with a diameter that is at least as large as each of said vane passageways.

18. The spray nozzle assembly of claim 17 in which said vane is diposed in an upstream end of said nozzle tip, said vane having an end portion extending outwardly of the upstream end of said nozzle tip, and means defining a which chamber downstream of said vane into which said tangentially directed liquid discharges.

19. The spray nozzle assembly of claim 18 in which said vane end portion is chamfered so as not to interfere with pivotal positioning of said nozzle tip within said body socket.

20. The spray nozzle assembly of claim 17 in which said nozzle tip passageway defines an upstream bore within which said vane is mounted, a whirl chamber downstream of said vane, and said discharge orifice downsteam of said whirl chamber.

21. A spray nozzle assembly for mounting on a liquid supply pipe comprising a body formed with a liquid flow passageway and a ball-shaped socket, means for mounting said body on said supply pipe with said flow passageway in communication with liquid in said pipe, a nozzle tip having a flow passageway in communication with said body passageway and a ball shaped mounting end for selected swivel positioning within said body socket, means for retaining said nozzle tip in a selected swivel position in said body socket so that liquid directed through said body and tip passageways discharges from said tip in a predetermined direction with respect to said body, a vane for imparting swirling movement to liquid directed through said tip whereby liquid discharging from said tip has a hollow cone spray pattern, said vane having a pair of liquid flow passageways communicating with said body and tip passageways, and said vane passageways each having a diameter of at least 0.22 the diameter of the ball shaped mounting end of said tip and extending through said vane without the existence of an axial see-through condition so that all liquid passing through the vane is tangentially directed.

22. The spray nozzle assembly of claim 21 in which said body mounting means includes means for releasably securing said body in mounted position on said pipe.

23. The spray nozzle assembly of claim 22 in which said releasable securing means is a clip mounted on said body for pivotal movement between a first position positively engaging said pipe and a second position removed from said pipe.

24. The spray nozzle assembly of claim 23 in which said body has an upstream nipple positioned into and communicating with the interior of said pipe.

25. The spray nozzle assembly of claim 22 in which said vane is disposed in an upstream end of said nozzle tip, said vane having an end portion extending outwardly of the upstream end of said nozzle tip, and means for defining a whirl chamber downstream of said vane.

26. A spray nozzle assembly comprising a body formed with a liquid flow passageway and a ball-shaped socket, a nozzle tip having a fluid passageway which defines a discharge orifice and which communicates with said body passageway, said nozzle tip having a ball shaped mounting end for selected swivel positioning within said body socket, means for retaining said nozzle tip in a selected swivel position in said body socket so that liquid directed through said body and tip passageways discharges from said tip in a predetermined direction with respect to said body, a vane disposed in the upstream end of said nozzle tip for imparting swirling movement to liquid directed through said tip whereby liquid discharging from said tip has a hollow cone spray pattern, said vane having an end portion extending outwardly of the upstream end of said nozzle tip and being formed with a pair of liquid flow passageways communicating with said body and tip passageways, and said vane passageways each having a diameter of at least 0.22 the diameter of the ball shaped mounting end of said tip.

27. The spray nozzle assembly of claim 26 in which said outwardly extending vane end portion is about 0.18 the overall length of said vane.

28. A spray nozzle assembly comprising a body formed with a liquid flow passageway and a ball-shaped socket, a nozzle tip having a fluid passageway for communication with said body passageway and a ball shaped mounting end for selected swirl positioning within said body socket, means for retaining said nozzle tip in a selected swivel position in said body socket so that liquid directed through said body and nozzle tip passageways discharges from said tip in a predetermined direction with respect to said body, a cylindrical vane disposed in an upstream end of said nozzle tip for imparting swirling movement to liquid directed through said tip whereby liquid discharging from said tip had a hollow cone spray pattern, said vane having an end portion extending outwardly of the upstream end of said nozzle tip, said vane having a pair of liquid flow passageways communicating with said body and tip passageways, and said vane passageways each having a diameter of at least 0.32 the diameter of the vane and extending through said vane without the existence of an axial see-through condition so that all liquid passing through the vane is tangentially directed.

29. The spray nozzle assembly of claim 28 in which said vane end portion is chamfered so as not to interfere with pivotal positioning of said nozzle tip within said body socket.

30. A spray nozzle assembly comprising a body formed with a liquid flow passageway and a ball-shaped socket, a nozzle tip having a fluid passageway for communication with said body passageway and a ball shaped mounting end for selected swivel positioning within said body socket, said nozzle tip fluid passageway further defining a discharge orifice, means for retaining said nozzle tip in a selected swivel position in said body socket so that liquid directed through said body and tip passageways discharges from said tip in a predetermine direction with respect to said body, a vane for imparting swirling movement to liquid directed through said tip, means defining a cylindrically configures whirl chamber downsteam of said vane and upstream of said nozzle tip discharge orifice whereby liquid discharging form said tip has a hollow cone spray pattern, said vane having a pair of liquid flow passageways communicating with said body and whirl chamber, and said vane passageways each having a diameter of at least 0.22 the diameter of the ball shaped mounting end of said tip and extending through said vane without the existence of an axial see-through condition so that all liquid passing through the vane is tangentially directed.

31. The spray nozzle assembly of claim 30 in which said nozzle tip discharge orifice is about the same size as each of the vane passageways.

32. The spray nozzle assembly of claim 30 in which said vane is disposed in an upstream end of said nozzle tip.

33. The spray nozzle assembly of claim 30 in which each said vane passageway directs liquid into said whirl chamber at an exit angle of at least 40° to the longitudinal axis of said tip.

34. The spray nozzle assembly of claim 33 in which each said vane passageway directs liquid into said whirl chamber at an exit angle of about 42° to the longitudinal axis of said tip.

* * * * *

UNITED STATES PATENT AND TRADEMARK OFFICE

CERTIFICATE OF CORRECTION

PATENT NO. : 5,143,298
DATED : September 1, 1992
INVENTOR(S) : Alexander S. Prokopoff It is certified that error appears in the above-indentified patent and that said Letters Patent is hereby corrected as shown below:

Col. 5, line 5, "35°" should be -- 35 --.

Col. 7, line 68, "diposed" should be -- disposed --.

Col. 10, line 18, "configures" should be -- configured --.

Col. 10, line 21, "form" should be -- from --.

Signed and Sealed this

Ninth Day of November, 1993

Bruce Lehman

*Attest:*

BRUCE LEHMAN

*Attesting Officer*

*Commissioner of Patents and Trademarks*